US010143275B2

(12) United States Patent
Serna

(10) Patent No.: US 10,143,275 B2
(45) Date of Patent: Dec. 4, 2018

(54) WALKING IMPLEMENT WITH INTEGRATED SMOKING APPARATUS

(71) Applicant: Gregory Serna, Denver, CO (US)

(72) Inventor: Gregory Serna, Denver, CO (US)

( * ) Notice: Subject to any disclaimer, the term of this patent is extended or adjusted under 35 U.S.C. 154(b) by 0 days.

(21) Appl. No.: 15/053,932

(22) Filed: Feb. 25, 2016

(65) Prior Publication Data

US 2017/0245605 A1 Aug. 31, 2017

(51) Int. Cl.
*A45B 3/16* (2006.01)

(52) U.S. Cl.
CPC ..... *A45B 3/16* (2013.01)

(58) Field of Classification Search
CPC ..... A45B 3/16
USPC ..... 135/15.1, 16, 17, 18, 19, 66
See application file for complete search history.

(56) References Cited

U.S. PATENT DOCUMENTS

| | | | | |
|---|---|---|---|---|
| 187,555 | A | 2/1877 | Peterson | |
| 190,859 | A * | 5/1877 | Hirsch et al. | A45B 3/16 131/178 |
| 253,011 | A | 1/1882 | Crowley | |
| 275,100 | A | 4/1883 | Weaver | |
| 395,426 | A | 1/1889 | Coursen | |
| 635,240 | A | 10/1899 | Eder | |
| 690,655 | A | 1/1902 | Khan | |
| 1,013,776 | A | 1/1912 | Hoffman | |
| 1,139,370 | A | 5/1915 | Putnam | |
| 1,144,825 | A | 6/1915 | Dula | |
| 1,157,314 | A | 10/1915 | Compte et al. | |
| 1,719,458 | A * | 7/1929 | Visitacion | A45B 3/16 135/66 |
| 1,754,808 | A | 4/1930 | Visitacion | |
| 1,764,694 | A | 6/1930 | Serota | |
| 2,311,049 | A | 2/1943 | Hedden | |
| 2,457,053 | A | 12/1948 | Lewis, Jr. | |
| 2,468,359 | A | 4/1949 | Dietz | |
| D154,736 | S | 8/1949 | Aronowitz | |
| 2,502,951 | A | 4/1950 | Hutton | |
| 2,642,884 | A | 6/1953 | Henderson et al. | |
| 3,032,048 | A | 5/1962 | Hoffman | |
| 3,363,639 | A | 1/1968 | Kurpis | |
| 3,443,820 | A | 5/1969 | Baker | |
| 3,561,782 | A | 2/1971 | Tyrack | |
| 3,705,590 | A | 12/1972 | Rains | |
| 3,709,233 | A | 1/1973 | Stelitano | |
| 3,863,648 | A | 2/1975 | Cathey | |
| 3,882,875 | A | 5/1975 | Frost | |
| 4,005,872 | A | 2/1977 | Rischert et al. | |
| 4,027,687 | A | 6/1977 | McGowan | |
| 4,044,781 | A | 8/1977 | Heggestuen | |
| 4,071,035 | A | 1/1978 | Boyd et al. | |
| 4,083,374 | A | 4/1978 | Jacobsen | |

(Continued)

FOREIGN PATENT DOCUMENTS

| | | |
|---|---|---|
| AT | 398275 | 11/1994 |
| CA | 463774 | 3/1950 |

(Continued)

*Primary Examiner* — Noah Chandler Hawk
(74) *Attorney, Agent, or Firm* — Merchant & Gould P.C.

(57) ABSTRACT

A walking stick has a handle, a foot, and a compartment. A smoking implement is movably disposed within the compartment. The smoking implement is positionable in a first position within the compartment and a second position extending from the compartment.

9 Claims, 9 Drawing Sheets

(56) References Cited

U.S. PATENT DOCUMENTS

| | | | |
|---|---|---|---|
| 4,097,169 | A | 6/1978 | Kelly |
| 4,134,409 | A | 1/1979 | McManus |
| 4,142,536 | A | 3/1979 | DeCarlo |
| 4,200,114 | A | 4/1980 | Waite |
| 4,204,551 | A | 5/1980 | Robinson |
| 4,229,015 | A | 10/1980 | Ramsey et al. |
| 4,243,058 | A | 1/1981 | Gershbein |
| 4,244,220 | A | 1/1981 | Henson et al. |
| 4,244,602 | A | 1/1981 | Allsop et al. |
| 4,278,099 | A | 7/1981 | Jacobsen |
| 4,278,274 | A | 7/1981 | Ray |
| 4,289,156 | A | 9/1981 | Ulics |
| 4,295,483 | A | 10/1981 | Smith |
| 4,428,390 | A | 1/1984 | Baird |
| 4,474,191 | A | 10/1984 | Steiner |
| 4,478,228 | A | 10/1984 | Chister |
| D283,370 | S | 4/1986 | Hill |
| 4,596,258 | A | 6/1986 | Steiner |
| 4,610,447 | A | 9/1986 | Byrd |
| 4,638,815 | A | 1/1987 | Yoshioka |
| 4,648,410 | A | 3/1987 | Seroussi |
| 4,721,125 | A | 1/1988 | Wang-Lee |
| 4,732,167 | A | 3/1988 | Nagano |
| 4,735,218 | A | 4/1988 | Akiko et al. |
| 4,788,988 | A | 12/1988 | Titus |
| 4,941,498 | A | 7/1990 | Escallier |
| 4,999,928 | A | 3/1991 | Tozier |
| 5,050,692 | A | 9/1991 | Beimgraben |
| 5,080,113 | A | 1/1992 | Bui |
| 5,197,502 | A | 3/1993 | Wang |
| 5,303,954 | A | 4/1994 | Suda |
| 5,351,701 | A | 10/1994 | Hsiao |
| 5,402,811 | A | 4/1995 | Weng |
| D359,162 | S | 6/1995 | Knight |
| 5,465,884 | A | 11/1995 | Bohl et al. |
| 5,495,867 | A | 3/1996 | Block |
| 5,605,170 | A | 2/1997 | Weng |
| 5,642,749 | A | 7/1997 | Perryman |
| 5,647,519 | A | 7/1997 | Brennan |
| 5,875,805 | A | 3/1999 | Nichols |
| D411,654 | S | 6/1999 | Olkey et al. |
| 6,073,632 | A | 6/2000 | Tolja |
| 6,095,168 | A | 8/2000 | Berges |
| 6,260,554 | B1 | 7/2001 | Rowland et al. |
| 6,431,176 | B1 | 8/2002 | Rice |
| 6,513,775 | B1 | 2/2003 | Hostetler |
| 6,711,772 | B2 | 3/2004 | Grassi |
| D606,297 | S | 12/2009 | Nardone |
| 7,694,685 | B1 | 4/2010 | Jones |
| 7,726,327 | B2 | 6/2010 | Battiston |
| 7,836,904 | B1 | 11/2010 | Cushman |
| 8,210,570 | B1 | 7/2012 | Nagle |
| 8,590,552 | B2 | 11/2013 | Stitely |
| 9,101,818 | B2 | 8/2015 | Carr |
| 2001/0039953 | A1 | 11/2001 | McCoy |
| 2002/0074006 | A1 | 6/2002 | Gunn |
| 2003/0159701 | A1 | 8/2003 | Carstens et al. |
| 2003/0221697 | A1 | 12/2003 | Erickson |
| 2006/0001254 | A1 | 1/2006 | Malone |
| 2009/0288670 | A1 | 11/2009 | Lee et al. |
| 2009/0293888 | A1 | 12/2009 | Williams et al. |
| 2010/0263681 | A1 | 10/2010 | Zhao |
| 2011/0088706 | A1 | 4/2011 | Badawi |
| 2011/0175338 | A1 | 7/2011 | Senseman |
| 2011/0317404 | A1 | 12/2011 | Gorey et al. |
| 2012/0060555 | A1 | 3/2012 | Parris |
| 2014/0251395 | A1 | 9/2014 | Bailar |

FOREIGN PATENT DOCUMENTS

| | | |
|---|---|---|
| CN | 201617273 | 11/2010 |
| CN | 101904607 | 12/2010 |
| CN | 202445277 | 9/2012 |
| GB | 115731 | 5/1918 |
| WO | 9713488 | 4/1997 |
| WO | 2015097424 | 7/2015 |

* cited by examiner

WALKING IMPLEMENT WITH INTEGRATED SMOKING APPARATUS

BACKGROUND

Walking sticks are used to support a person who needs assistance and/or balance when moving. Such sticks can be used on both flat and uneven surfaces, depending on the level of infirmity and/or the amount of support desired by the person.

SUMMARY

In one aspect, the technology relates to an apparatus having: a walking stick having a handle and a foot, wherein the walking stick at least partially defines a compartment; and a smoking implement movably disposed within the compartment, wherein the smoking implement is positionable in a first position substantially within the compartment and a second position extending from the compartment. In an embodiment, the walking stick further includes an internal conduit, and wherein when in the second position, the smoking implement is in fluid communication with the internal conduit. In another embodiment, the walking stick further defines an opening in an outer surface of the walking stick, wherein the opening is in fluid communication with the internal conduit. In yet another embodiment, the internal conduit is configured to be connected to an external tube. In still another embodiment, the smoking implement is pivotably engaged with the walking stick.

In another embodiment of the above aspect, the smoking implement is removably engaged with the walking stick. In an embodiment, the apparatus further includes at least one light, an electrical circuit, and a battery for providing power to the at least one light via the electrical circuit. In another embodiment a cover is movably disposed so as to selectively cover the compartment.

In another aspect, the technology relates to an apparatus having: a walking stick at least partially defining a compartment; a smoking implement pivotably connected to the walking stick, wherein in a first position, the smoking implement is disposed entirely within the compartment; and a receiver for removably receiving a tube. In an embodiment, the apparatus has a tube. In another embodiment, when in a second position, the smoking implement at least partially extends from the compartment. In yet another embodiment, the receiver is disposed within the walking stick and is configured to store the tube. In still another embodiment, the receiver is formed in an exterior of the walking stick and is configured to be connected to the tube.

In another embodiment of the above aspect, the apparatus has a power source and a circuit disposed in the walking stick. In an embodiment, the apparatus includes an accessory connected to the circuit and configured to be powered by the power source. In another embodiment, the accessory has a light.

In another aspect, the technology relates to an apparatus having: a walking stick; an inhalation circuit disposed within the walking stick; a smoking apparatus moveably disposed within a compartment defined by the walking stick, wherein when in a first position, the smoking apparatus is in fluidic communication with the inhalation circuit; and a tube removably disposed in the walking stick, wherein the tube is selectively engageable with the inhalation circuit. In an embodiment, the tube is selectively engageable with a first end of the inhalation circuit disposed proximate an exterior surface of the walking stick. In another embodiment, the smoking apparatus is in fluidic communication with the inhalation circuit, when the smoking apparatus is engaged with a second end of the inhalation circuit. In yet another embodiment, the second end is disposed proximate a compartment at least partially defined by the walking stick.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The same number represents the same element or same type of element in all drawings.

DETAILED DESCRIPTION

Figure 1A:
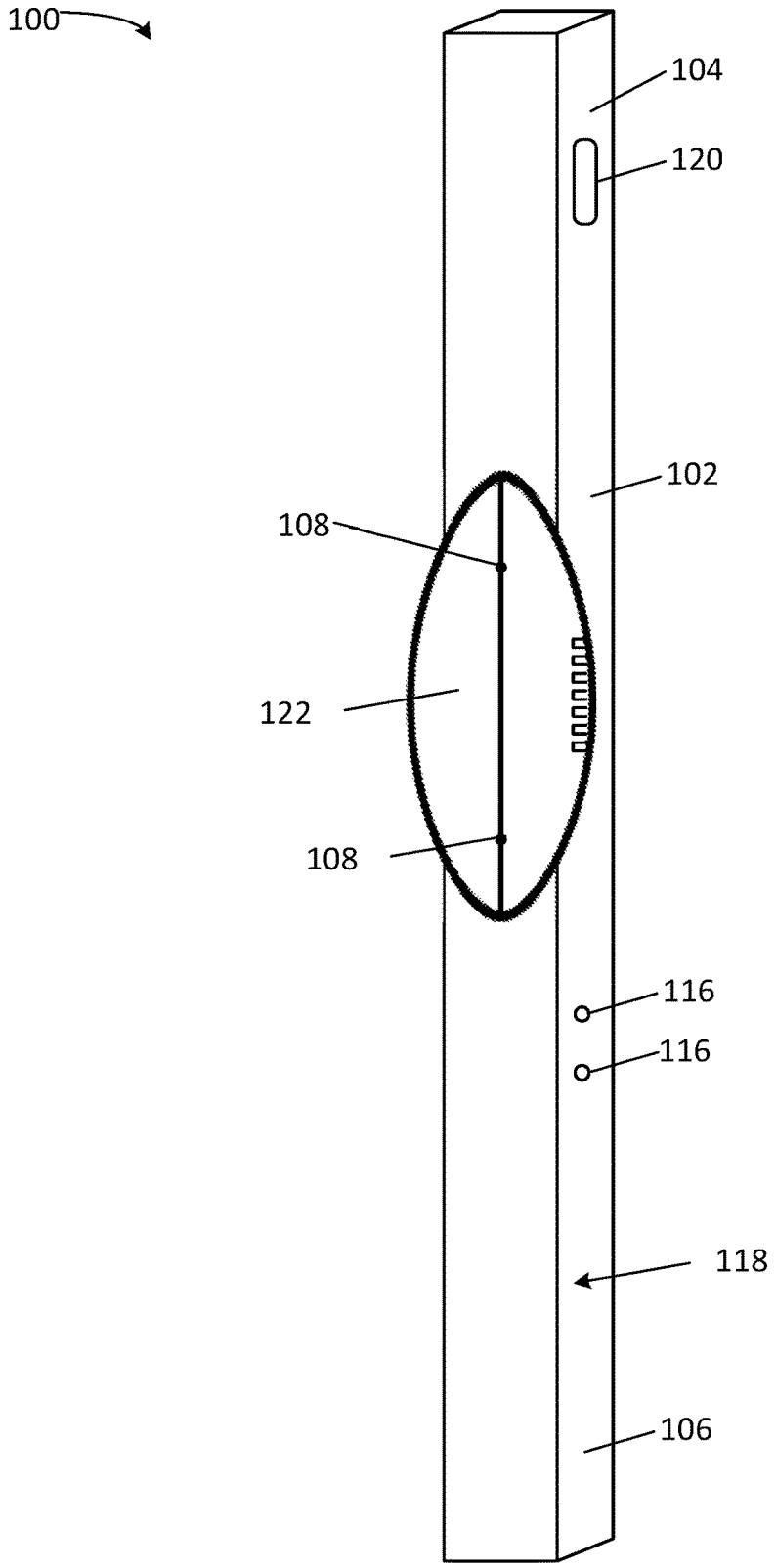
FIGS. 1A and 1B are perspective views of a walking stick in accordance with an example of the present technology.
Figure 1B:
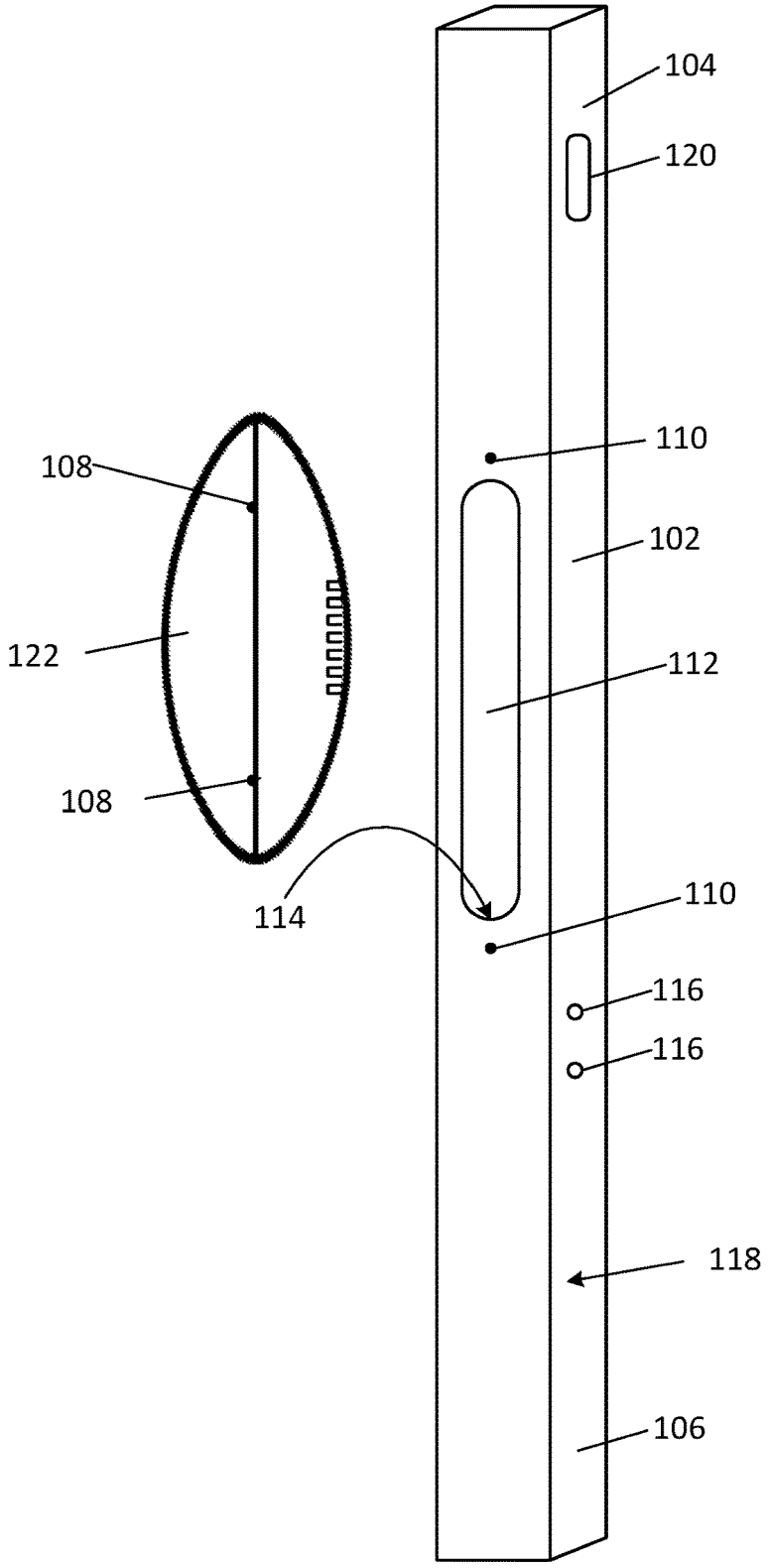

FIGS. 1A and 1B are perspective views of a walking stick 100 in accordance with an example of the present technology. FIGS. 1A and 1B are described substantially simultaneously. The walking stick 100 includes a generally elongate body 102 having a handle 104 disposed at an upper end and a foot 106 disposed at a lower end. The depicted walking stick 100 has a simplified configuration for illustrative purposes, but may be any form factor as required or desired for a particular application. For example, the walking stick 100 is depicted having a square cross-section, but other shapes, such as round, triangular, hexagonal, and other shapes are contemplated. Additionally, the handle 104 may include a gripping element that may be cushioned for comfort and/or contoured to ensure a secure grip thereof. The foot 106 may include a non-skid tread or other element that resists slippage on wet surfaces. The foot may also include a number of discrete rubber feet so the walking stick may stand freely. Alternatively or additionally, the foot 106 may be fitted with a pointed end to help ensure traction on snow or ice.

In the depicted example, a decorative element 122 is removably fixed to the body 102. The decorative element 122 may be in any form factor required or desired for a particular application and may be removably secured to the body 102 via implanted magnets 108, bolts, screws, or other fasteners. If magnets 108 are utilized, matching magnets 110 may be disposed within the body 102 of the walking stick 100. When the decorative cover 122 is removed from the body 102, a sealing cover 112 is exposed. This sealing cover 112 can completely cover or be disposed in an opening 114 defined by the body 102. In that case, the sealing cover 112 is configured to prevent ingress of dirt, water, or other contaminants through the opening 114 (and into a compartment described below). The sealing cover 112 need not, but may, form a watertight seal. The walking stick 100 may also include a number of lights 116 disposed proximate an exterior surface 118 thereof for decorative or other purposes. A switch 120 may be used to control the lights 116. The lights may be LEDs or other light types and may be configured to emit light in steady, alternating, or other modes. In addition to decorative lights, the lights 116 may also be for a defined purpose, such as a strobe light, head light, etc. Additionally or alternatively, the lights may be replaced or supplemented with one or more audible element such as speakers, to emit sounds such as chimes, bells, etc., as described further below.

Figure 2A:
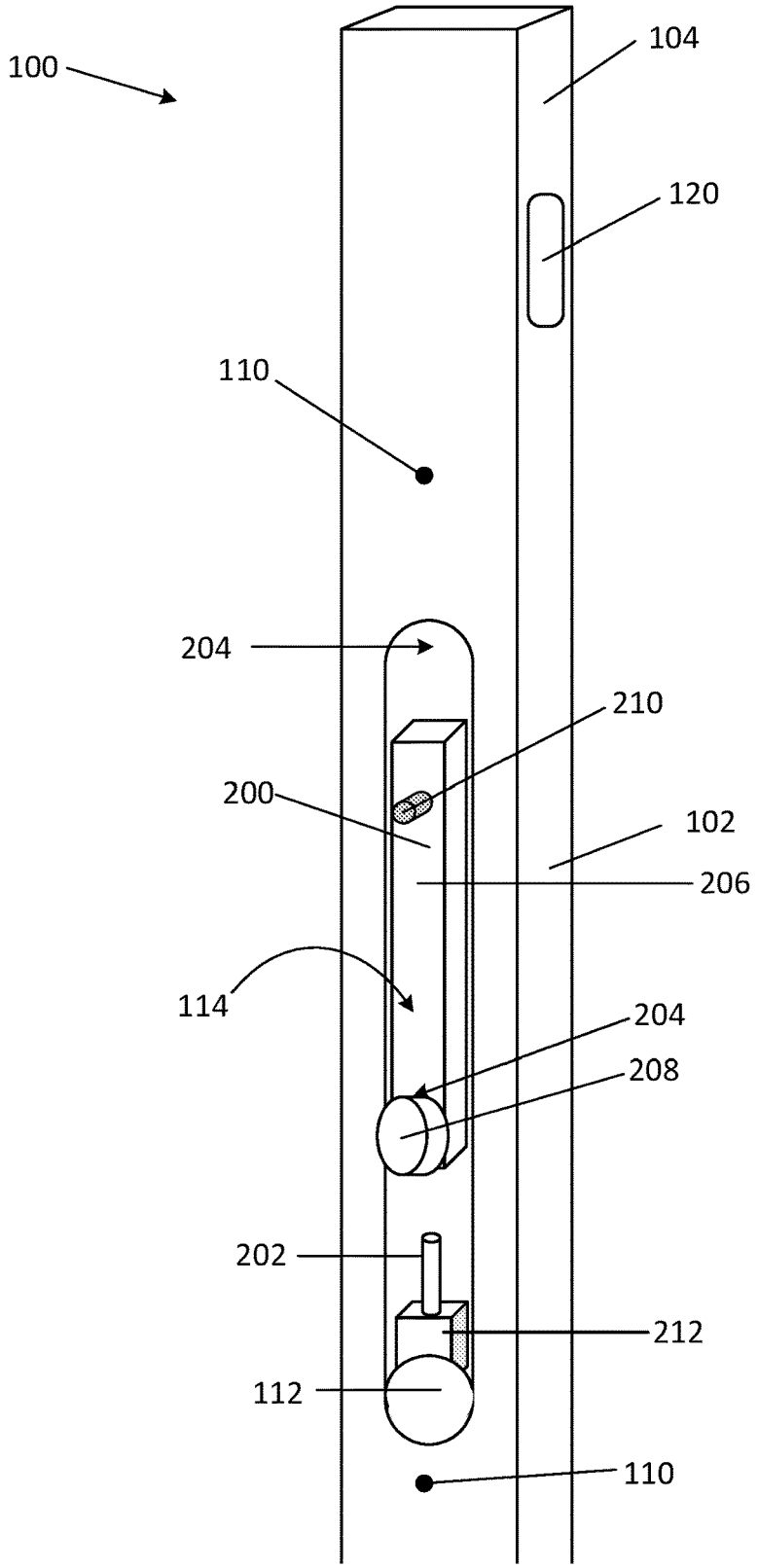
FIGS. 2A-2D are partial perspective views of the walking stick of FIG. 1A, with a smoking apparatus and tube in various positions.
Figure 2B:
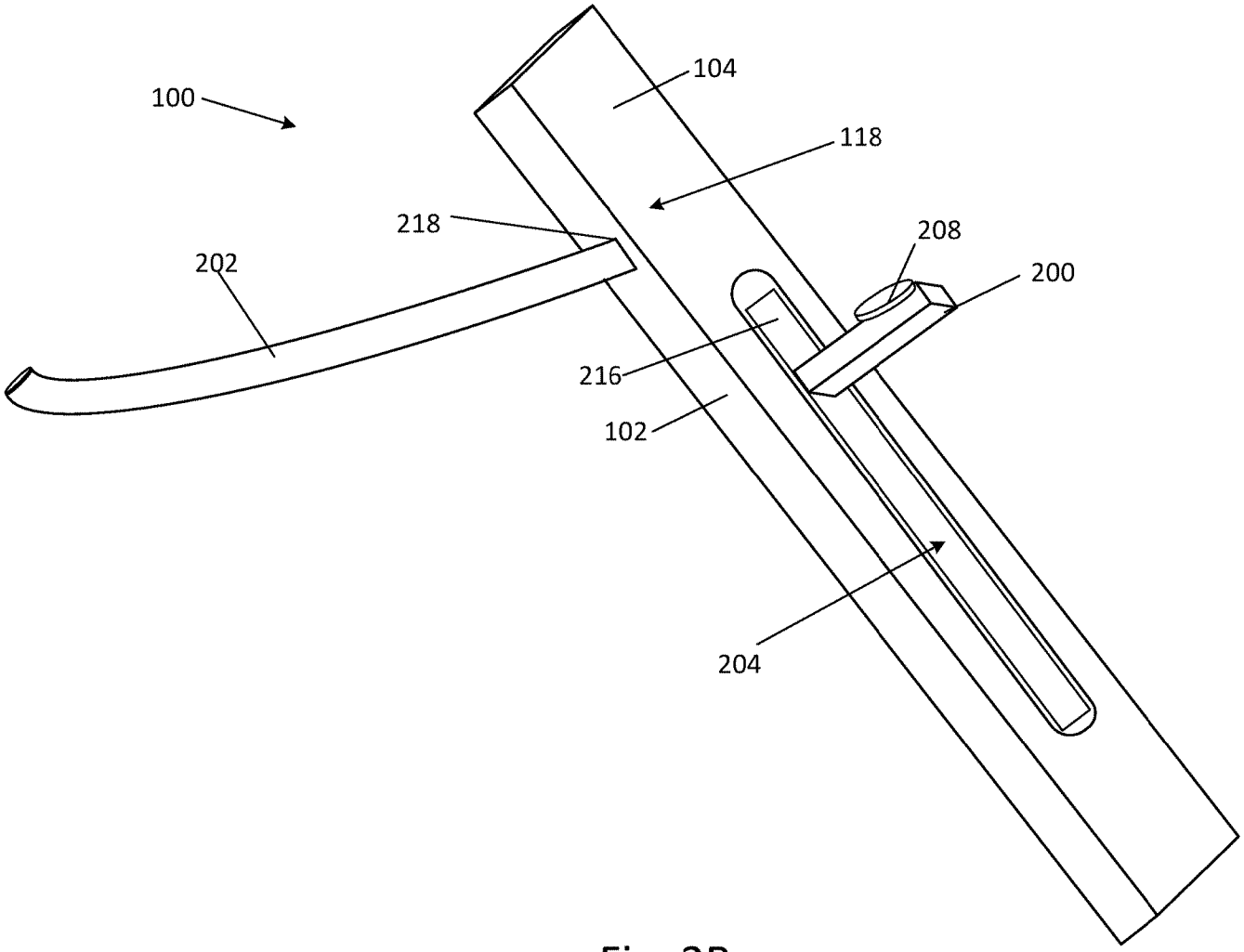
Figure 2C:
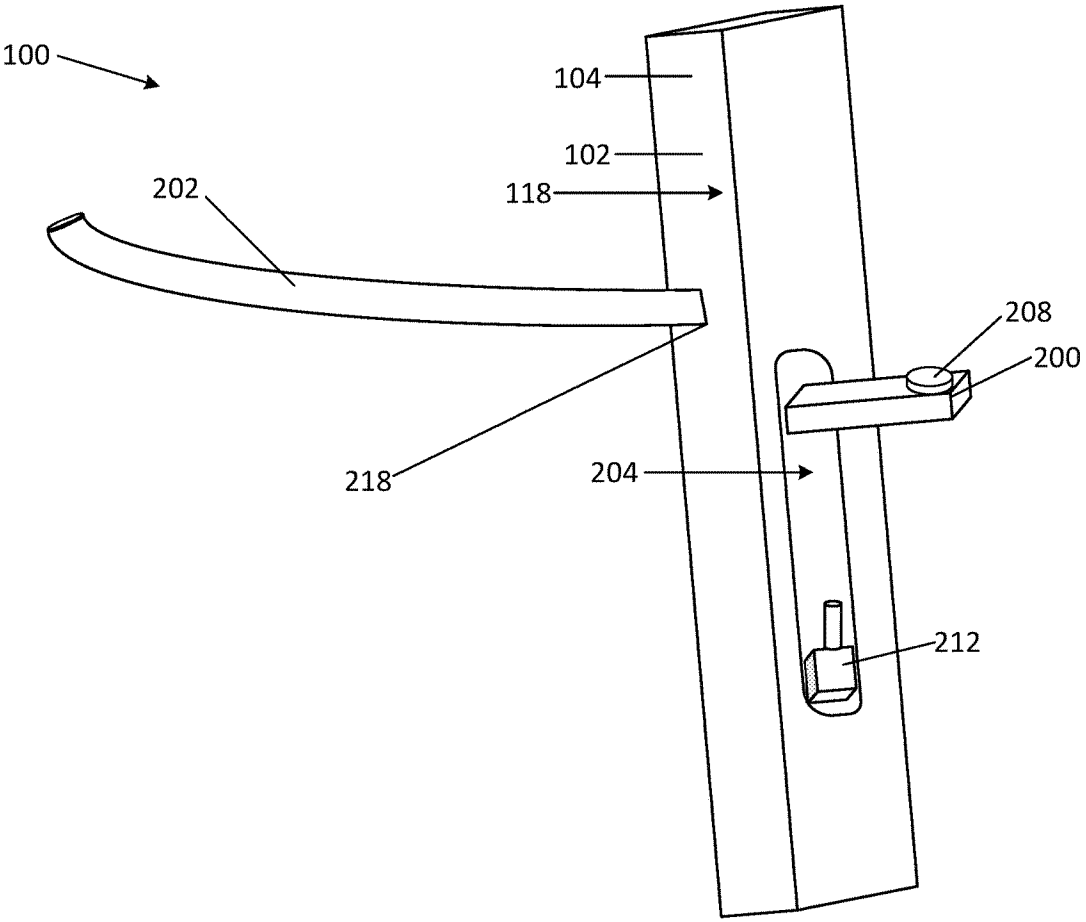

FIGS. 2A-2C are partial perspective views of the walking stick 100 of FIG. 1A, with a smoking implement 200 and a tube 202 in various positions. These figures are described simultaneously. The walking stick body 102 defines a compartment 214 that is covered by the sealing cover 112, which in the depicted configuration, has been slid to an open position. The compartment 204 provides access for a number of components disposed therein. Specifically, the smoking implement 200 is disposed entirely within the compartment 204 when the implement 200 is in a first position, as depicted in FIG. 2A. The implement 200 includes a body 206 having secured thereto a bowl 208 and a connector 210. The bowl 208 and connector 210 fluidically connected thereto via a conduit (not shown) in the implement body 206. The tube 202 is disposed in a tube receiver 212 which stores the tube between uses. The tube receiver 212 may be one or more clamps, brackets, or conduits configured to receive and hold the tube 202.

Figure 2D:
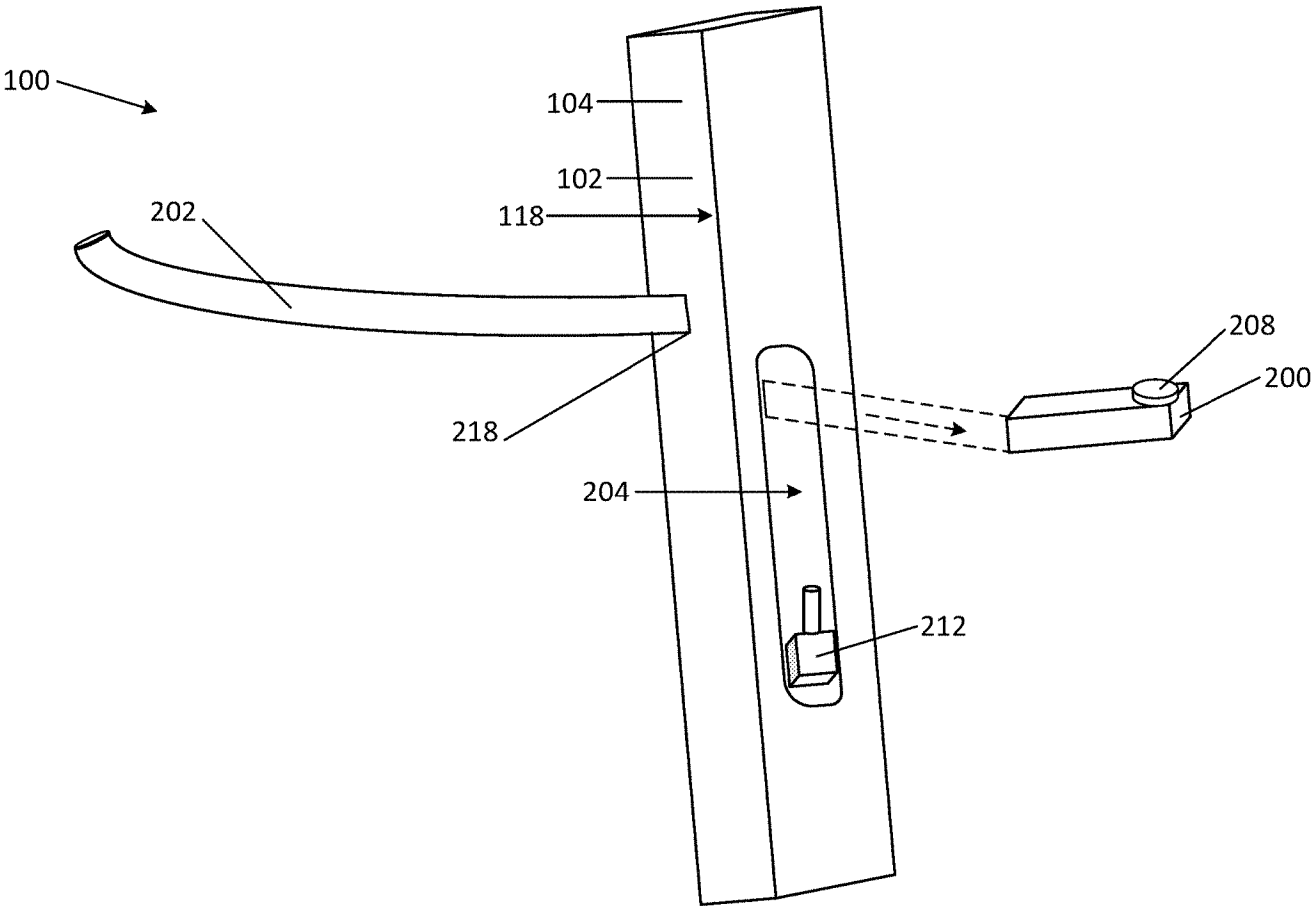

FIG. 2B depicts the smoking implement 200 in an intermediate position. In the intermediate position, the implement 200 has been pivoted so as to at least partially extend from the compartment 214. In examples, the implement 200 may be connected to an interior of the compartment 214 via a pivot or hinge connection. In another example, depicted by FIG. 2D, the implement 200 may be removable from the compartment 214 and positionable in the intermediate position depicted. In another example, the implement 200 may be pivotably and slidably connected to the compartment 214. In the latter example, the implement 200 may first be pivoted to the intermediate position depicted in FIG. 2B, then slid to a second, final position depicted in FIG. 2C. Regardless of the specific configuration, the connector 210 is configured to engage with a first end 216 of an inhalation circuit that terminates proximate or in the compartment 214.

Once engaged, the implement 200 is in the second, final position depicted in FIG. 2C and the bowl 208 may be filled with tobacco or other smoking medium. The tube 202 may be removed from the tube receiver 212 and connected to a second end 218 of the inhalation circuit, which is disposed proximate the exterior surface 118 of the body 102, generally proximate the handle 104. In certain examples, the second end 218 of the inhalation circuit may be called an external tube receiver, since it receives the tube 202 when the tube is disposed exterior to the walking stick 100. Once the tube 202 is engaged with the second end 218 of the inhalation circuit and the connector 210 is engaged with the first end 216 of the inhalation circuit, the tube is then in fluidic communication with the bowl 208, from which the smoking medium may be lit and inhaled, via the tube 202. Although a smoking implement 200 having a bowl 208 is depicted, other smoking implements, such as electronic cigarettes, may be utilized. For example, a standard electronic cigarette may be connected to the connector 210 via a small tube.

Figure 3A:
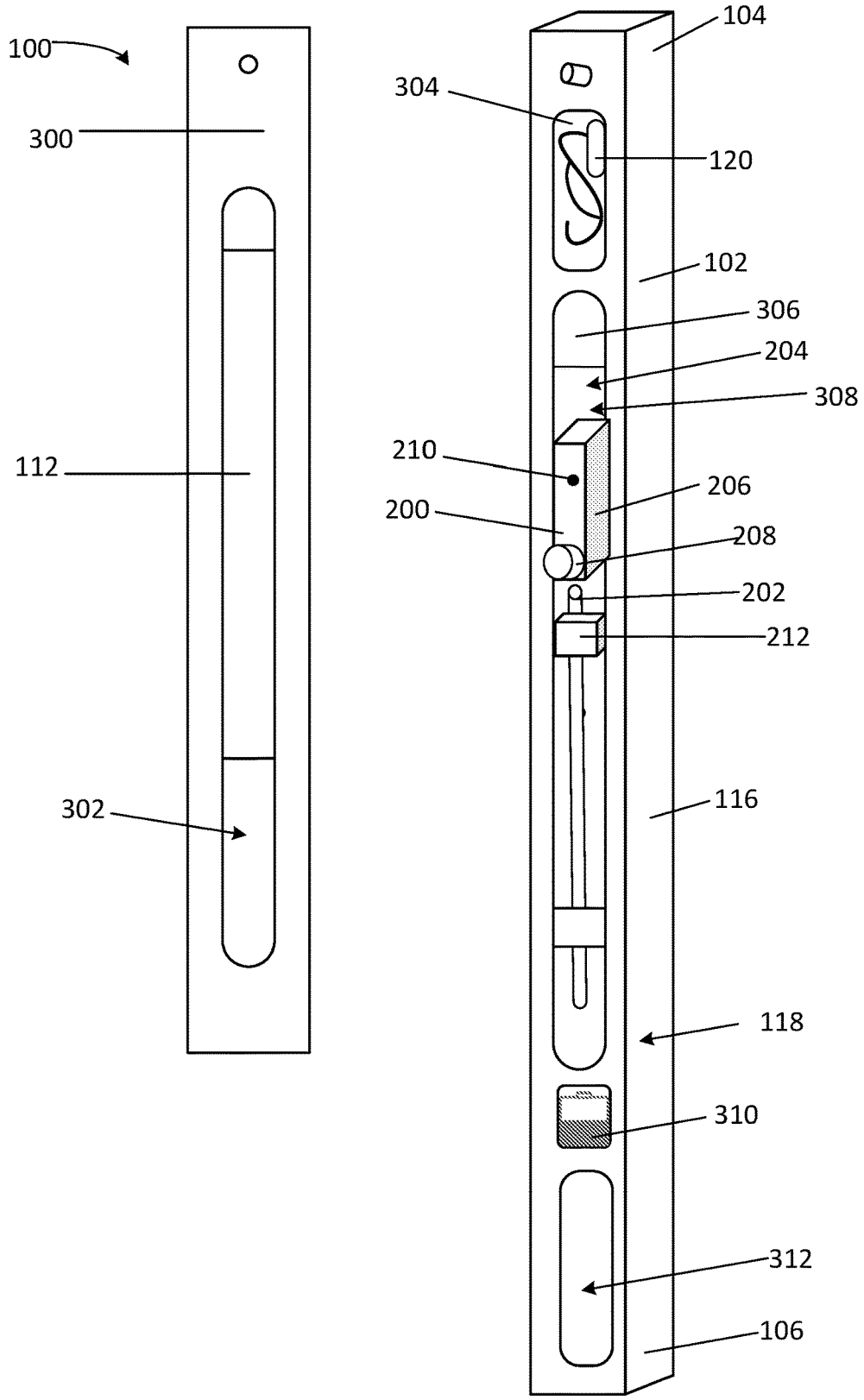
FIG. 3A is a perspective view of the walking stick of FIG. 1A with a cover thereof removed.
Figure 3B:
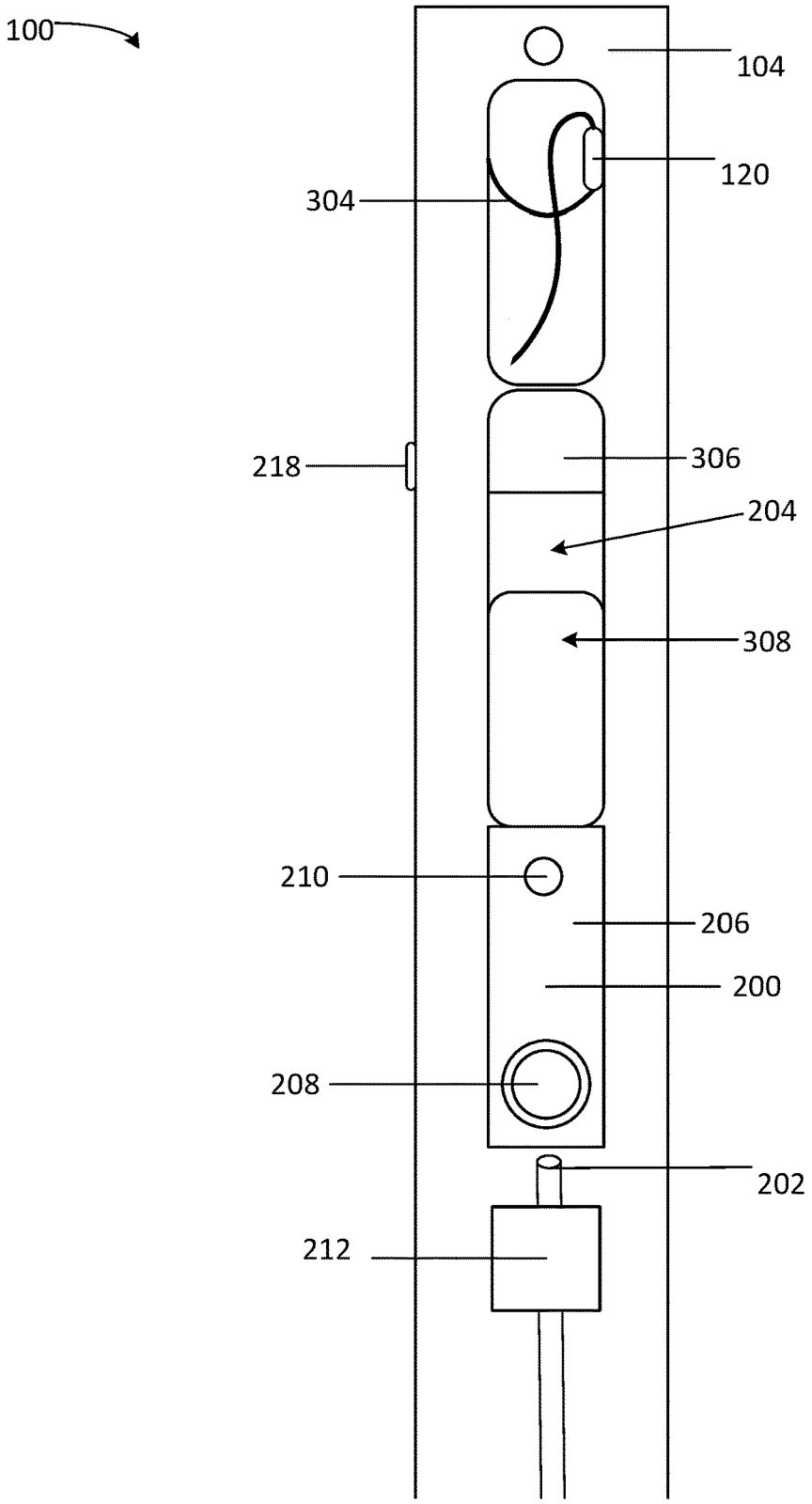
FIGS. 3B-3C depict partial perspective views of the walking stick of FIG. 1A with the cover thereof removed.
Figure 3C:
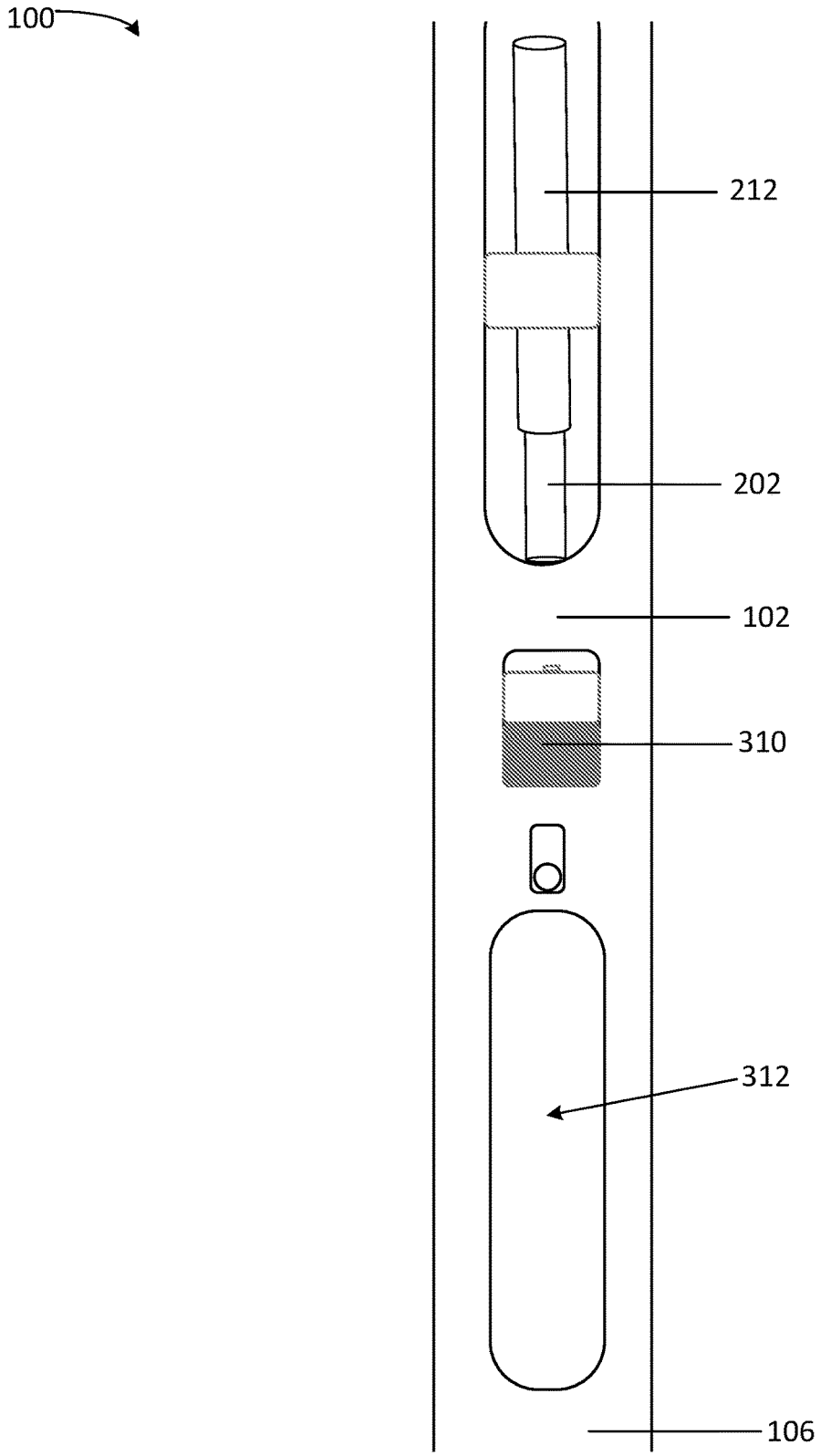

FIG. 3A is a perspective view of the walking stick 100 of FIG. 1A with a cover 300 thereof removed, to more clearly show internal components thereof. As can be seen, the cover 300 is configured to slidably receive the sealing cover 112 in a slot 302, the rear of which is depicted in FIG. 3A. In other examples, the sealing cover may be removable (similar to the decorative cover 106 described above). FIGS. 3B-3C depict partial perspective views of the walking stick 100 of FIG. 1A with the cover 300 removed. FIGS. 3A-3C are described simultaneously. Beginning proximate the handle 104, the switch 120 is disposed within the body 102 and connected to an electrical circuit 304. As such, the switch 120 can control accessories such as lights 116, audible elements, or other components. Inhalation circuit 306 may be in the form of a block of material as depicted, or a discrete conduit or tubular element. The smoking implement 200 is depicted in a position that provides an open volume 308 in the compartment 204 in which may be stored tobacco or other smoking medium between uses. The tube receiver 212 is, in the depicted example, a conduit that may slidably receive the tube 202. As such, the tube 202 may be conveniently stored in the walking stick 100 between uses, so as to limit the possibility of the tube 202 being lost. A battery or other power source 310 may be disposed in the walking stick 100 proximate the foot 106. The battery 310 provides power to the electrical circuit 304, which ultimately powers the lights 116 or other accessories. Such accessories can be disposed in an accessory compartment 312 and can include electronics modules such as audible horns and noise makers such as air horns, sirens, etc. Additionally, the electronics module may include Bluetooth or other types of speakers, a cellular phone, etc. Alternatively or additionally, the accessory compartment 312 may be used for the storage of small items.

Portions of the walking stick that form part of the inhalation circuit are preferably manufactured from non-toxic materials. Such materials include fruit and other woods such as cherry, apple, briar, maple, black walnut, oak, olive, rosewood, manzanita, mesquite, beech, hickory, mountain laurel, mahogany, ebony, morta, plum, mango, and so on. Metals include food- or medical-grade metals such as stainless steel, platinum, etc. Other materials, such as corn cob, meerschaum, clay or other stone may be used for certain components. In examples, the bowl may be manufactured of stone or glass and may contain water, if adequately sized. Plastics include food- or medical-grade plastics, such as oxygen tube, may be used. The remaining portions of the walking sticks may be manufactured from materials typically used in the manufacture of walking sticks, such as woods, metals, or plastics, or may be made from the same materials as described above. The walking stick may be painted, embossed, carved, or otherwise decorated. Additionally, the walking stick may include one or more reflectors or reflective surfaces. Other useful accessories can be incorporated into various portions of the stick, including a compass or mechanical bell, such as a bicycle bell.

The terms first, second, upper, lower, retracted, extended, etc., as used herein, are relative terms used for convenience of the reader and to differentiate various elements of the systems described herein from each other. In general, unless otherwise noted, the terms are not meant to define or otherwise restrict location of any particular element or operation of the window.

This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. An apparatus comprising:

a walking stick comprising a handle and a foot, wherein the walking stick at least partially defines a compartment;

a smoking implement movably disposed within the compartment, wherein the smoking implement is positionable in a first position substantially within the compartment and a second position extending from the compartment, wherein the smoking implement is removably engaged with the walking stick;

an internal conduit, disposed in the second position such that the smoking implement is in fluid communication with the internal conduit;

a receiver in fluid communication with the internal conduit for removably receiving an external tube; and the external tube operational for inhaling a smoking medium and extending from the receiver on an outer surface of the walking stick while the walking stick is operational for use as a walking stick.

2. The apparatus of claim 1, wherein the receiver defines an opening in the outer surface of the walking stick, wherein the opening is in fluid communication with the internal conduit.

3. The apparatus of claim 1, wherein the smoking implement is pivotably engaged with the walking stick.

4. The apparatus of claim 1, further comprising at least one light, an electrical circuit, and a battery for providing power to the at least one light via the electrical circuit.

5. The apparatus of claim 1, further comprising a cover movably disposed so as to selectively cover the compartment.

6. An apparatus comprising:

a walking stick comprising a handle and a foot, wherein the walking stick at least partially defines a compartment;

a smoking implement movably disposed within the compartment, wherein the smoking implement is positionable in a first position substantially within the compartment and a second position extending from the compartment, wherein the smoking implement is pivotably engaged with the walking stick;

an internal conduit, disposed in the second position such that the smoking implement is in fluid communication with the internal conduit;

a receiver in fluid communication with the internal conduit for removably receiving an external tube; and the external tube operational for inhaling a smoking medium and extending from the receiver on an outer surface of the walking stick while the walking stick is operational for use as a walking stick.

7. The apparatus of claim 6, wherein the receiver defines an opening in the outer surface of the walking stick, wherein the opening is in fluid communication with the internal conduit.

8. The apparatus of claim 6, further comprising at least one light, an electrical circuit, and a battery for providing power to the at least one light via the electrical circuit.

9. The apparatus of claim 6, further comprising a cover movably disposed so as to selectively cover the compartment.

* * * * *